US006741023B2

(12) United States Patent
Pirovic

(10) Patent No.: US 6,741,023 B2
(45) Date of Patent: May 25, 2004

(54) FLUORESCENT TANNING LAMP WITH IMPROVED SERVICE LIFE

(75) Inventor: Arpad Pirovic, Woodbridge, CT (US)

(73) Assignee: Light Sources, Inc., Orange, CT (US)

( * ) Notice: Subject to any disclaimer, the term of this patent is extended or adjusted under 35 U.S.C. 154(b) by 168 days.

(21) Appl. No.: 09/901,818

(22) Filed: Jul. 10, 2001

(65) Prior Publication Data

US 2003/0011297 A1 Jan. 16, 2003

(51) Int. Cl.[7] ..... H01J 1/62
(52) U.S. Cl. ..... 313/492
(58) Field of Search ..... 313/492, 613, 313/242

(56) References Cited

U.S. PATENT DOCUMENTS 4,891,551 A * 1/1990 Will et al. ..... 313/492
5,214,351 A * 5/1993 Nieda ..... 313/619
5,686,795 A * 11/1997 Sakoske et al. ..... 313/613

FOREIGN PATENT DOCUMENTS

WO WO 81/01344 5/1981

* cited by examiner

*Primary Examiner*—Renee Luebke
*Assistant Examiner*—Ann McCamey
(74) *Attorney, Agent, or Firm*—Fattibene & Fattibene; Paul A. Fattibene; Arthur T. Fattibene

(57) ABSTRACT

An electrode shield for a fluorescent tanning lamp comprising an open cup encircling a filament or electrode increasing the service life of the fluorescent tanning lamp. The cup having an open end acts as a shield reducing the sputtering of impurities onto the glass tube and contaminating the phosphor surface. In one embodiment, the cup is electrically and thermally coupled to an electrode support. The life of the fluorescent tanning lamp is greatly increased despite the use of relatively high currents and large number of on and off cycles.

12 Claims, 2 Drawing Sheets

FLUORESCENT TANNING LAMP WITH IMPROVED SERVICE LIFE

FIELD OF THE INVENTION

The present invention relates generally to fluorescent lamps used in tanning beds, and particularly to an electrode shield for use therewith.

BACKGROUND OF THE INVENTION

Fluorescent lamps generally have a limited service life. The service life is proportional to the life of the electrode and emission material. The emission material may be expended due to ion bombardment, vaporization of emission material, and chemical reactions between the emission material and gaseous impurities in the lamp. The starting process additionally produces higher voltages, which reduce the life of the lamp. This is particularly troublesome in tanning lamps, which use relatively high current and are cycled on and off repeatedly. Tanning lamps generally have currents ranging between 800 milliamperes and 2000 milliamperes. This current is higher than the typical fluorescent lamp current, which may range between 400 milliamperes and 800 milliamperes. Heat generated from the higher currents in a tanning lamp also result in shorter lamp life. Therefore, there is a need for an improved fluorescent tanning lamp structure that improves performance and increases the useful life of a fluorescent tanning lamp.

SUMMARY OF THE INVENTION

The present invention is directed to a florescent tanning lamp with an improved service life. A tanning lamp has an electrode at either end of a glass tube. A cup having an open end contains or surrounds each of the electrodes and acts as an electrode shield. In one embodiment, the cup is mounted on an insulated stem of the fluorescent tanning lamp and is electrically insulated from the electrode. In another embodiment, the cup is supported by a cup support attached to an electrode support or a lead wire attached to the electrode and is electrically and thermally coupled thereto and aids in shielding and dissipating heat from the cup.

Accordingly, it is an object of the present invention to provide an improved fluorescent tanning lamp that has an increased service life.

It is another object of the present invention to provide a fluorescent tanning lamp that can accommodate repeated on and off cycles while minimizing any reduction in service life.

It is an advantage of the present invention that reduced sputtering impurities are entered into the arc stream resulting in cleaner phosphor surfaces and providing a longer effective UV output.

It is a further advantage of the present invention that a more uniform electrode temperature is obtained resulting in less severe evaporation of emission material, thereby reducing contamination of the phosphor.

It is a further advantage of the present invention that a cooler cold spot temperature is obtained behind the electrode providing a more stable mercury vapor pressure.

It is a feature of the present invention that a cup surrounding the electrode is electronically coupled to a lead wire of the fluorescent tanning lamp.

These and other objects, advantages, and features will become readily apparent in view of the following more detailed description.

DETAILED DESCRIPTION OF THE PREFERRED EMBODIMENTS

Figure 1:
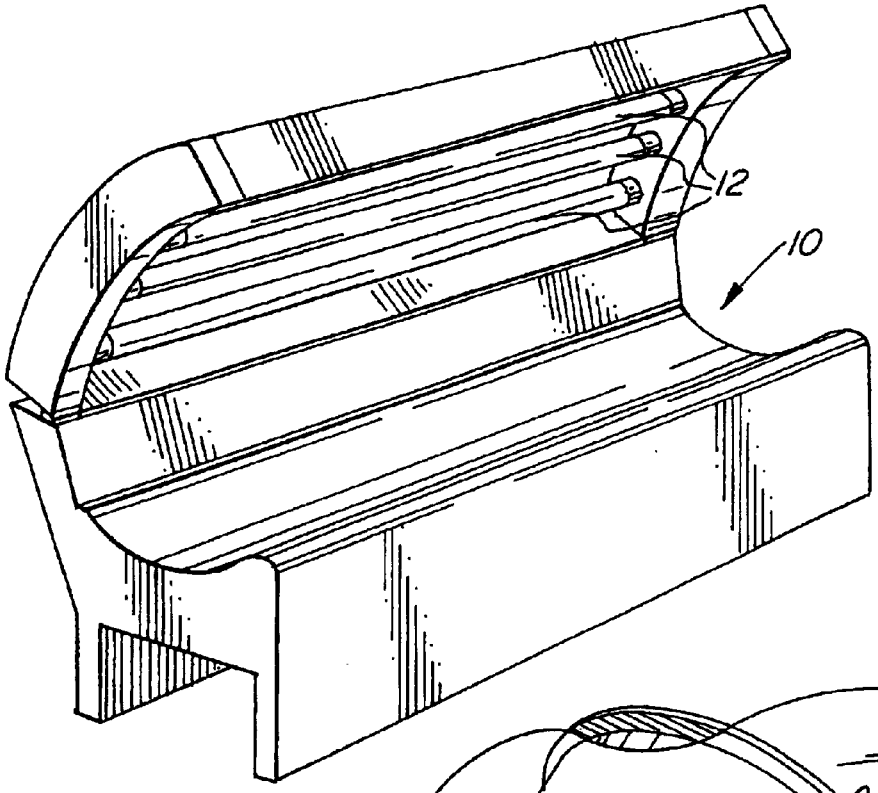
FIG. 1 is a perspective view schematically illustrating a tanning fluorescent lamp in a tanning bed.

FIG. 1 schematically illustrates a tanning bed 10 having a plurality of tubular fluorescent tanning lamps 12 therein. Each of the fluorescent tanning lamps 12 has an electrode placed in each end. Fluorescent tanning lamps 12 are often cycled on and off repeatedly throughout the day. This cycling on and off often reduces the service life of prior fluorescent tanning lamps.

Figure 2:
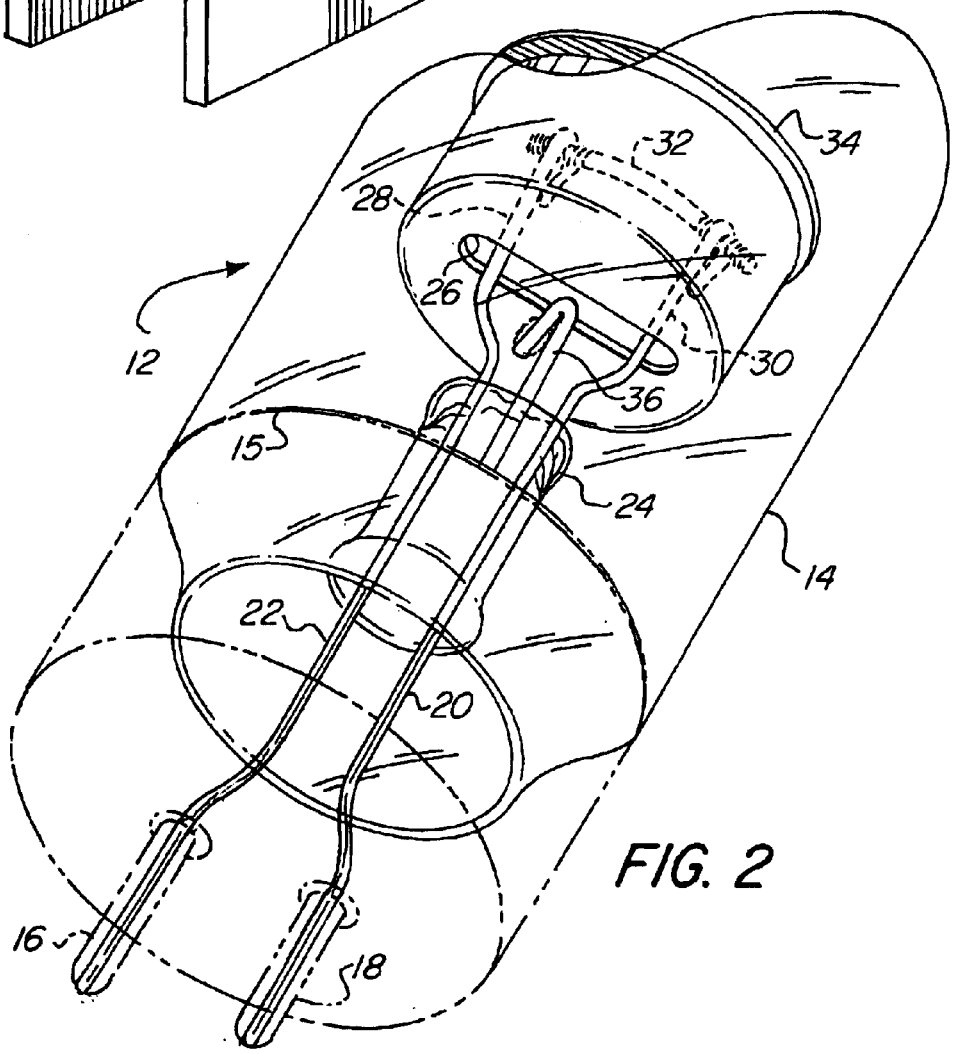
FIG. 2 is a perspective view illustrating one end of a fluorescent tanning lamp.

FIG. 2 illustrates one end of the fluorescent tanning lamps 12, illustrated in FIG. 1. The fluorescent tanning lamp 12 comprises a glass tube 14. On one end of the glass tube 14 is a seal 15. A first electrical contact pin 16 and a second electrical contain pin 18 are placed on the end of the fluorescent tanning lamp. The contact pins 16 and 18 are adapted to fit within a socket of a fluorescent tanning lamp fixture within the tanning bed 10, illustrated in FIG. 1. Lead wires 20 and 22 electrically couple the contact pins 18 and 16 to a filament or electrode 32. The lead wires 20 and 22 extend through an insulating stem 24. The lead wires 20 and 22 extend through a slot 26 formed in the base of a cup 34 and form electrode supports 28 and 30 attached to electrode 32. Cup 34 surrounds or encircles the electrode 32 on all sides, but for a top opening. The top opening is preferable free from any material so as to assist in dissipating heat and is open for the entire diameter of the cylindrical cup 34. The cup 34 acts as an electrode shield to shield electrode 32. The electrode 32 is held in position by electrode supports 28 and 30 extending through slot 26 and into the interior of cup 34. The electrode 32 generally has an emission material thereon. Cup 34 is held in position by shield support 36. One end of the shield support 36 extends into the glass stem 24 and the other end of the shield support 36 is attached to the base of cup 34. In this embodiment, the cup 34 is electrically insulated or isolated or dead.

Figure 3:
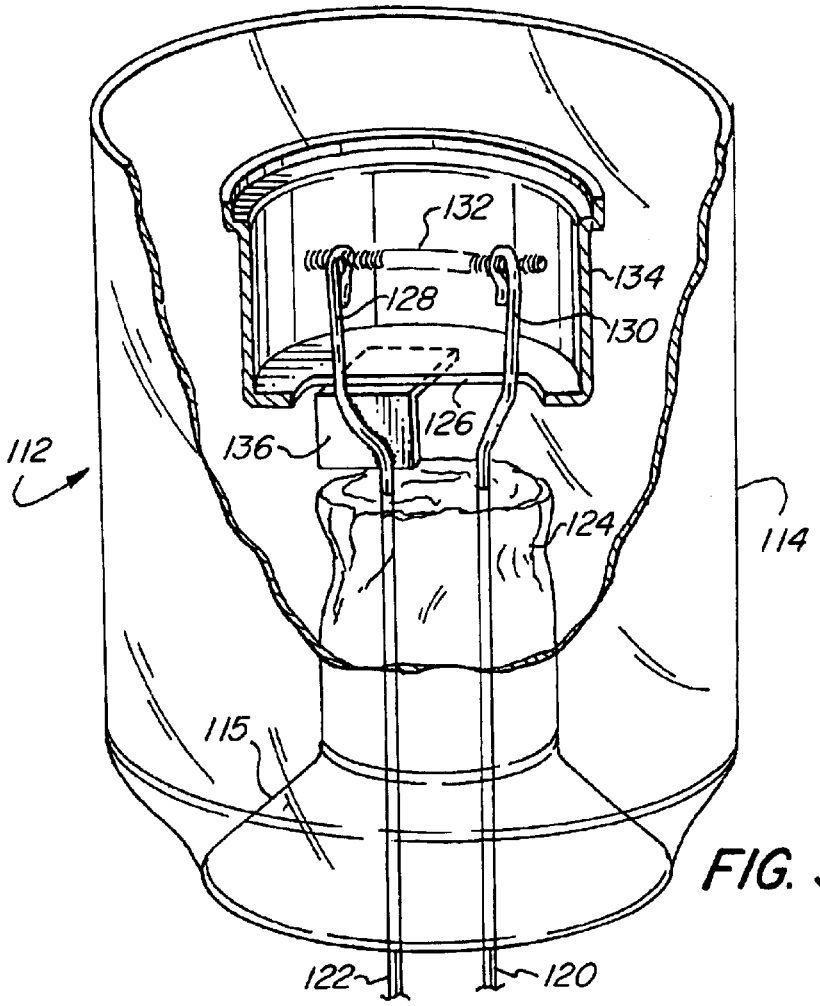
FIG. 3 is a partial cross section of one end of another embodiment of a fluorescent tanning lamp.

FIG. 3 illustrates another embodiment of the present invention. In this embodiment, the fluorescent tanning lamp 112 comprises a tube 114 sealed with seal 115. Lead wires 120 and 122 extend through a glass stem 124 and through a slot 126 in the base of cup 134. Supports 128 and 130 hold filament or electrode 132. The electrode 132 may have an emission material thereon. The cup 134 is open on the end opposing the slot 126. A shield support 136 is electrically coupled to the lead wire 122 and the electrode support 128. The shield support 136 is attached to the base of the cup 134. The shield support 136 has a size sufficient to act as a heat sink and is made of an electrically conductive material with desirable heat sink thermal properties. The shield support 136 may be made of the same material as the cup 134, which may be iron, nickel, or any equivalent material or compound. In this embodiment, the cup 134 is live, because the cup 134 is electrically coupled to the lead wire 122 and electrode support 128. The shield support 136 may be attached to the cup 132, the lead wire 122 or electrode support 128 by any conventional means such as soldering or any equivalent thereto.

Figure 4:
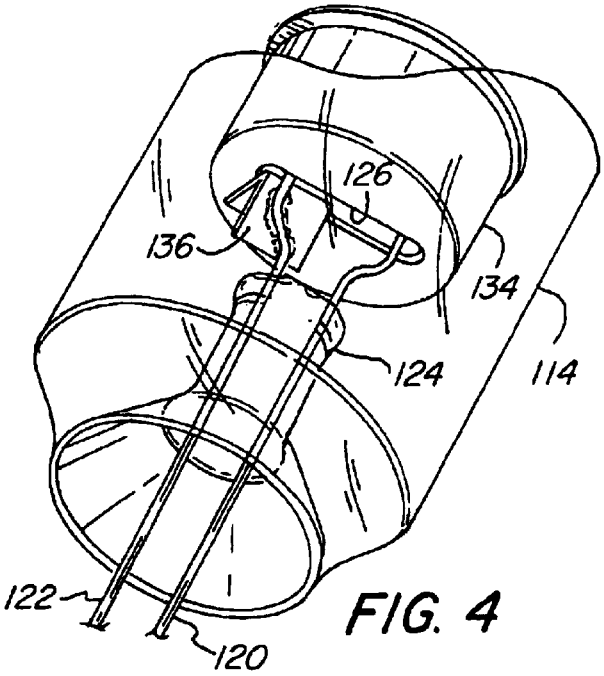
FIG. 4 is a perspective view of one end of a fluorescent tanning lamp.

FIG. 4 illustrates another view of the embodiment of the present invention illustrated in FIG. 3. The shield support 136 has a relatively large surface area and helps conduct heat away from the electrode 132, preventing high temperatures from developing. The shield support 136 is in the shape of an L-shaped bracket and has a width substantially greater than the diameter of the lead wire 122 or electrode support 128, illustrated in FIG. 3. This width helps to secure the cup 134 and provides additional surface area to dissipate heat.

Figure 5:
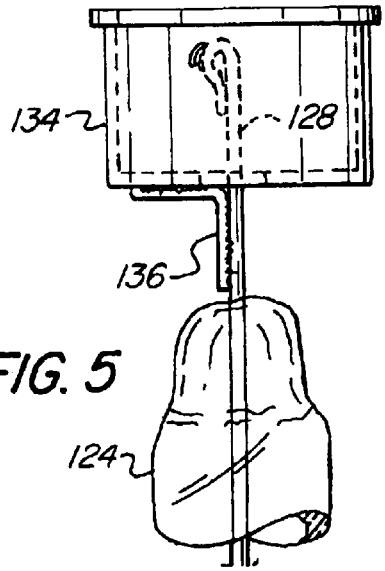
FIG. 5 is an elevational view of an electrode structure of one end of a fluorescent tanning lamp.

FIG. 5 is an elevational view illustrating the electrode structure without the glass tube. The L-shaped electrode support 136 is clearly illustrated attached to the cup 134 and electrode support 136.

The present invention provides a cup to act as an electrode shield that greatly improves the service life of fluorescent tanning lamps that are frequently cycled on and off and that are operated at relatively high curents. The present invention reduces the end darkening of a fluorescent lamp behind the electrode or filament. Additionally, sputter may be contained within the cup. This reduces the impurities that may enter the arc stream resulting in cleaner phosphor surfaces within the glass tube, enhancing the longevity of the effective ultraviolet output of the tanning lamp. Additionally, the cup provides a uniform electrode temperature resulting in less severe evaporation of emission material contained on the electrode, resulting in less phosphor contamination. The cup additionally provides a cooler cold spot temperature behind the electrode or filament resulting in more stable mercury vapor pressure and more efficient use.

While the present invention has been described with respect to several preferred embodiments, it will be obvious to those skilled in the art that variations may be made without departing from the spirit and scope of this invention.

What is claimed is:

1. A fluorescent tanning lamp adapted for operating at currents greater than 800 milliamperes comprising:

a fluorescent tube;

an electrode placed within an end of said fluorescent tube;

an electrode support holding said electrode;

a stem holding said electrode support within said fluorescent tube;

a metal cup having a bottom with a slot adapted to pass through said electrode support and an open end opposite said electrode and positioned to surround said electrode, said metal cup being electrically isolated from said electrode; and means, attached to the bottom of said metal cup, for dissipating heat, whereby said metal cup shields said electrode.

2. A fluorescent tanning lamp adapted for operating at currents greater than 800 milliamperes as in claim 1 wherein:

said means for dissipating heat comprises an L-shaped bracket having a width substantially greater than a diameter of said electrode support, whereby heat is conducted away form said electrode and additional surface area is provided to dissipate the heat.

3. A fluorescent tanning lamp adapted for operating at currents greater than 800 milliamperes comprising:

a fluorescent tube;

an electrode placed within said fluorescent tube;

an electrode support holding said electrode;

a stem holding said electrode support within said fluorescent tube;

a metal cup having a bottom with a slot adapted to pass through said electrode support and an open end opposite said electrode and positioned to surround said electrode, said metal cup being held by said electrode support; and means, attached to the bottom of said metal cup, for dissipating neat, whereby said metal cup shields said electrode.

4. A fluorescent tanning lamp as in claim 3, wherein:

said metal cup is electrically coupled to said electrode support.

5. A fluorescent tanning lamp as in claim 3 wherein:

said means for dissipating heat comprises a bracket, one end of said bracket attached to the bottom of said metal cup and another end of said bracket attached to said electrode support.

6. A fluorescent tanning lamp adapted for operating at currents greater than 800 milliamperes as in claim 3 wherein:

said means for dissipating heat comprises an L-shaped bracket having a planar surface area and a width substantially greater than a diameter of said electrode support, whereby heat is conducted away form said electrode and additional surface area is provided to dissipate the heat.

7. A fluorescent tanning lamp adapted for operating at currents greater than 800 milliamperes for use in a tanning bed comprising:

a fluorescent tube;

an electrode placed within said fluorescent tube;

a stem attached to said florescent tube;

an electrode support held in said stem;

a lead wire connected to said electrode support;

a cup having a bottom end with a slot adapted to pass through said electrode support and an open end opposite the bottom end, said cup positioned to substantially surround said electrode; and an L-shaped cup support attached to the bottom of said cup and said electrode support, said L-shaped cup support having a planar surface area and a width substantially greater than a diameter of said electrode support and capable of conducting heat away from said electrode and dissipating the heat, whereby said cup is electrically and thermally coupled to said electrode support and said lead wire, whereby said cup shields said electrode and said L-shaped cup support causes heat to be dissipated.

8. A fluorescent tanning lamp for use in a tanning bed as in claim 7 wherein:

said cup is cylindrical with a diameter and the open end is open over substantially the entire diameter.

9. A fluorescent tanning lamp for use in combination with a tanning bed comprising;

a tube coated with phosphor having two ends;

a pair of electrodes, one of said pair of electrodes placed in each of the two ends of said tube;

a pair of electrode supports each having a diameter and holding each of said pair of electrodes;

a pair of stems, one each of said pair of stems attached to one of the two ends of said glass tube and holding a respective one of said pair of electrode supports;

a pair of lead wires coupled to each of said pair of electrode supports;

a pair of cups each having a bottom with a slot therein adapted to pass through a respective one of said pair of electrode supports and having an open end opposing the slot, each one of said pair of cups positioned to surround a respective one of said pair of electrodes;

a pair of L-shaped cup supports having a width substantially greater than the diameter of each of said pair of electrode supports, one each of said pair of cup supports attached to the bottom of a respective one of said pair of cups and one of said pair of electrode supports, whereby each of said pair of cups is held in position encircling one of said pair of electrodes and is electrically and thermally coupled to one of said pair of electrode supports; and an emissive material placed on each of said pair of electrodes, whereby said pair of cups act as an electrode shield and heat sink.

10. A fluorescent tanning lamp for use in combination with a tanning bed as in claim 9 wherein:

said fluorescent tanning lamp is adapted for operating at currents greater than 800 milliamperes.

11. A fluorescent tanning lamp for use in combination with a tanning bed as in claim 9 wherein:

said fluorescent tanning lamp is adapted for operating at currents between 800 milliamperes and 2000 milliamperes.

12. A fluorescent tanning lamp for use in combination with a tanning bed as in claim 9 further comprising:

a tanning bed adapted to receive the fluorescent tanning lamp.

* * * * *